US006386206B2

(12) United States Patent
Lee

(10) Patent No.: US 6,386,206 B2
(45) Date of Patent: May 14, 2002

(54) HAIR IRON

(76) Inventor: Man Taek Lee, 528-49, Bangbae-2Dong, Seocho-Gu, Seoul (KR)

( * ) Notice: Subject to any disclaimer, the term of this patent is extended or adjusted under 35 U.S.C. 154(b) by 0 days.

(21) Appl. No.: 09/802,099

(22) Filed: Mar. 8, 2001

(30) Foreign Application Priority Data

Mar. 10, 2000 (KR) ..... 2000-11969
Jul. 3, 2000 (KR) ..... 2000-37805

(51) Int. Cl.[7] ..... A45D 2/40
(52) U.S. Cl. ..... 132/225
(58) Field of Search ..... 132/223, 224, 132/225; 219/222, 225

(56) References Cited

U.S. PATENT DOCUMENTS 943,321 A * 12/1909 Shero ..... 132/224
1,455,696 A * 5/1923 Wright ..... 132/224
4,739,151 A * 4/1988 Smal ..... 132/225
4,870,250 A * 9/1989 Rizzuto et al. ..... 219/225
5,357,988 A 10/1994 Nakamura ..... 132/232
5,799,671 A 9/1998 Takimae ..... 132/225
5,823,204 A * 10/1998 Todd ..... 132/224
5,934,293 A 8/1999 Kaizuka ..... 132/225
6,223,753 B1 * 5/2001 Lo ..... 132/225

* cited by examiner

*Primary Examiner*—Todd E. Manahan
(74) *Attorney, Agent, or Firm*—Steve Cha; Klauber & Jackson

(57) ABSTRACT

The hair iron includes a pair of arms (12 and 14) opened and closed by a pivot (16), and each arm has a gripping portion (18) and a hair treatment portion (20). The hair treatment portions are provided with respective hair treatment members between which hair is held and pressed to hairstyle the hair. The hair treatment members are of the type of having planar top surfaces (22 and 24), or undulating top surfaces (62 and 64). An image marker of concave and convex images (26, 28, 66 and 68) are provided on the opposing surfaces of the hair treatment members, which are also supported by supporting protrusions (32 and 34) formed on the arms. When the arms are closed, the hair is held between the hair treatment members and part of the hair is also held between the image marker so that an image is imparted with the part of the hair by the pressure and temperature applied to the hair.

9 Claims, 8 Drawing Sheets

FIG. 1 [PRIOR ART]

HAIR IRON

BACKGROUND OF THE INVENTION

1. Field of the Invention

This invention relates to a hair iron for straight or wave-perming hairs, especially to a hair iron for expressing a predetermined desired image at hair itself, in which the hair iron is used at barbor shops, beauty salons and homes.

2. Description of the Related Arts

A hair iron for perming hair into straight or wave hairdos of the type including a pair of arms or fingers pivotally joined to each other to make an opening and closing movement is known in the art. An example of that type of hair iron, as shown in FIG. 1, has a pair of arms joined by a pivot 1 at their one ends to enable closing and opening movements according to appliance and release of the gripping force to the arms. The first and second arms 2 and 3 are provided with forming plates 5 and 6, respectively. Opposing surfaces of the forming plates have planar or corrugated surfaces which match each other. At least one of the forming plates 5 and 6 is connected to a heater 4 to heat the plates electrically. A desired hairstyle is accomplished by pulling down little by little the hair iron pressing the arms after holding hair between the forming plates 5 and 6. At this time, what state of the hair is attained is dependent on how the hair comes into contact with the forming plates 5 and 6 between which the hair is grasped, because hair, when heated, will conform to the shape of the plates on which the hair is held for a certain period of time, as is well-known.

The conventional hair irons of the type as examplarily illustrated in the above are able to make hair curled, waved, or straightened, but there have been no arts or hair irons for providing decorative figures of a character, pattern, or design to the hair itself in a region-wise manner. Therefore, hair-dressing accessories have been often employed after treating the hair by using the conventional hair irons. Such hair dressing accessories are separately attached to the hair, not expressed on the very hair itself as decorative designs.

In addition, with the conventional hair irons in which the forming plates 5 and 6 approach and leave with each other by the opening and closing movement of the arms around a shaft such as a pivot pin so as to hold therebetween and treat the hair, contact about the end portions of the forming plates 5 and 6 takes place without the even surface-to-surface contact of the forming plates 5 and 6 over the entire opposed surfaces thereof so that the large portions of surfaces of the forming plates remain without contact with each other. Uneven contact between the forming plates leads to the poor gripping of the hair so as to result in a bad hairdressing state.

SUMMARY OF THE INVENTION

Accordingly, it is an object of the present invention to provide a hair iron having an image marker capable of expressing an image of a character, pattern, or predetermined design by forming an embossed-intaglioed or concave-convex portion on the very hair itself at a desired portion in the hair.

It is another object of the present invention to provide a hair iron having support protrusions which cause a seesaw movement of hair treatment members to allow the hair treatment members provided to each arm to be in a close and even surface-to-surface contact when the arms are closed so that the gripping and treatment of hair is attained effectively.

It is still another object of the present invention to provide a hair iron able to apply various types of hair styles by employing twined hair treatment members for holding and treating the hair which are attachable and releasable to a pair of arms or another pair of hair treatment members installed in the corresponding arms, respectively.

According to the present invention, a hair iron comprises: a gripping portion; twined hair treatment members designed to be heated up for pressing and treating hair therebetween; and an image marker of a concave and convex type provided on opposing surfaces of said hair treatment members for imparting an image with the hair by holding and pressing the hair between said hair treatment members when said hair treatment members approach each other.

BRIEF DESCRIPTION OF THE DRAWINGS

FIG. 5 is a sectional view taken along line A—A in FIG. 3 in which

FIG. 7 is a sectional view taken along line B—B in FIG. 6 in which

DETAILED DESCRIPTION OF THE PREFERRED EMBODIMENTS

Figure 1:
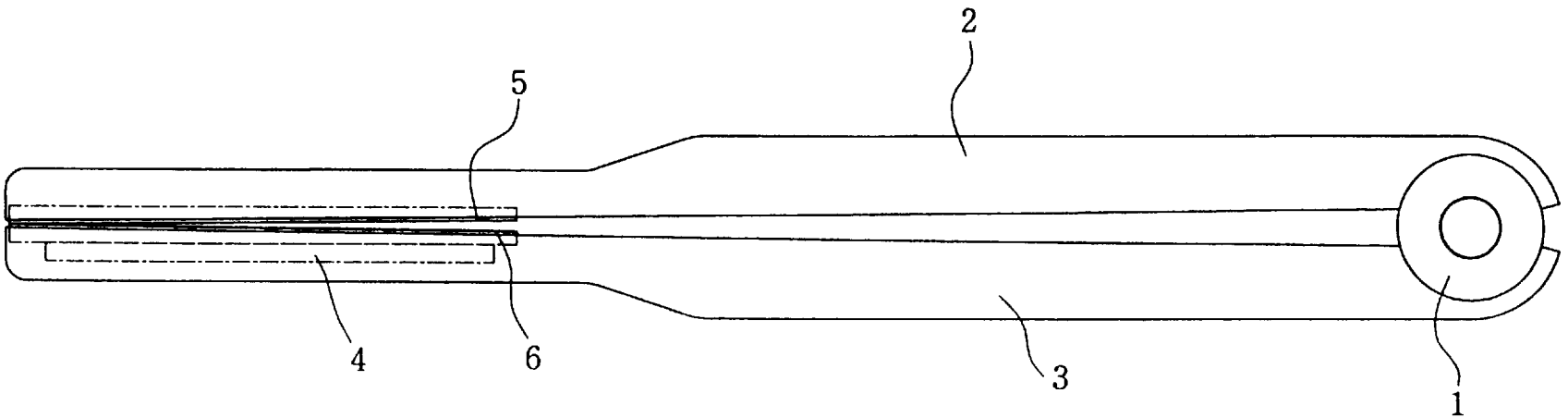
FIG. 1 is a side view of a conventional example of a hair iron.
Figure 2:
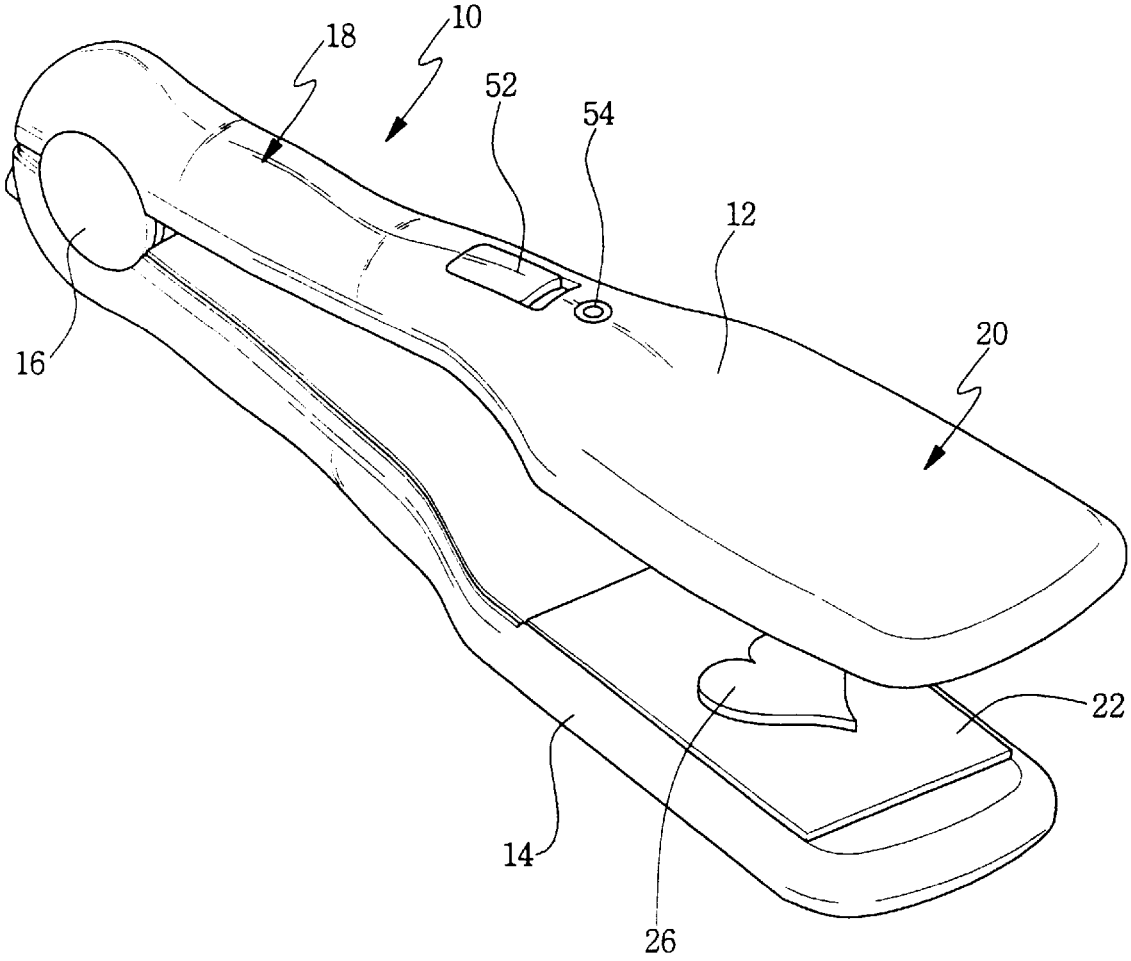
FIG. 2 is a perspective view of a hair iron according to the first embodiment of the present invention.
Figure 3:
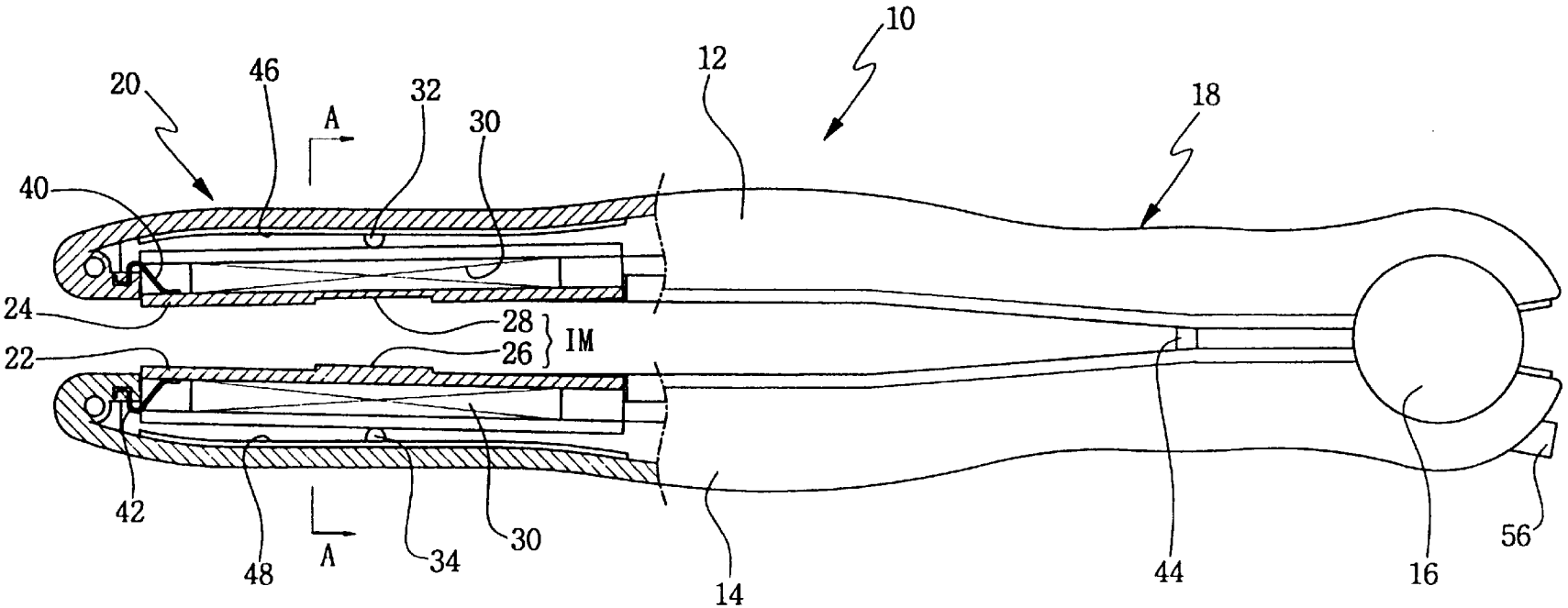
FIG. 3 is a side view of the hair iron with a partially sectional view of hair treatment portions in FIG. 2.

With reference to FIGS. 2 through 5, one embodiment of the present invention will be described in detail. A hair iron 10 includes a pair of arms 12 and 14 which approach and leave through the opening and closing movements of the arms 12 and 14 around a pivot 16 serving as a shaft. The hair iron 10 also includes a gripping portion 18, which is placed near the pivot 16 to grip the hair iron 10 when using, and a hair treatment portion 20 which is placed away from the pivot 16 to hold and treat hair.

The hair treatment portion 20 is provided to one end portion of each arm 12, 14 and has larger surface area than that of the gripping portion 18. The hair treatment portion 20 takes preferably a generally rectangular shape. Each hair treatment portion 20 of the arms 12 and 14 is provided with a hair treatment member 22, 24 which has a heater 30 housed therein. With the opposed surfaces of the hair treatment members 22 and 24, a convex image marker 26 and a concave image marker 28 are provided respectively so that the convex and concave image markers 26 and 28 constitute an image marker IM.

The image marker IM is able to take various types of image such as a character, pattern, or design which is imparted with the hair. Namely, when a pair of arms 12 and 14 are closed, the hair treatment members 22 and 24 approach to each other so that the convex and concave image markers 26 and 28 are also matched each other. At this time, a tress of hair is held between the hair treatment members 22 and 24 and heated by the temperature from the heater 30 so that the hair tress is permed. During this process, an image I of various types such as a heart (refer to FIGS. 1 and 8) is imparted with the hair tress which is placed between the convex and concave image markers 26 and 28 of the hair treatment members 22 and 24.

The arms 12 and 14 are provided with supporting protrusions 32 and 34, respectively, at about the middle in a longitudinal direction of the hair treatment members 22 and 24 to support the members 22 and 24. Preferably, the members 22 and 24 are supported by a pair of support protrusions 34 and 34*a* as especially shown in FIG. 4. In addition, the hair treatment members 22 and 24 are also supported at their bottom surfaces 36 by resilient restoring members, 40 and 42, respectively, which are provided with the respective arms 12 and 14. Rails 46 and 48 are formed extending along the longitudinal axes of the respective arms 12 and 14. The rails 46 and 48 are provided with both inner ends of the respective arms 12 and 14 in such a manner that wings 38 and 38*a* each extending from either sides of each hair treatment member 22, 24 are placed on the respective rails 46 and 48 so as to allow the hair treatment members 22 and 24 to make a seesaw movement. To accommodate the seesaw movement of the hair treatment members 22 and 24, the width W of each rail 46, 48 is spacious enough to receive the respective wings 38 and 38*a*.

Figure 4:
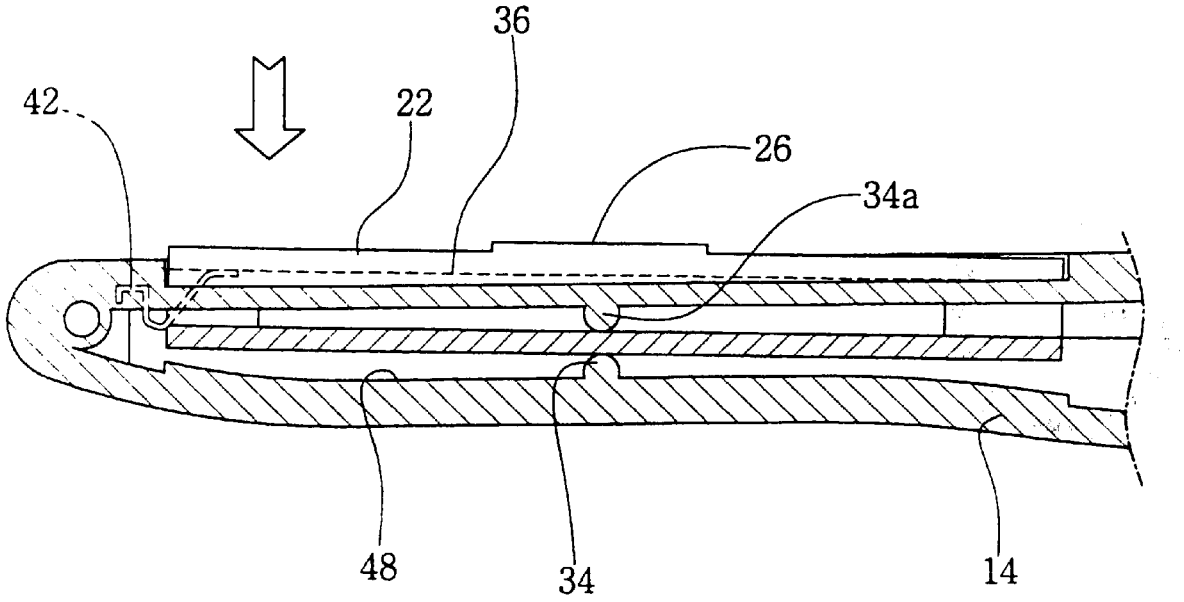
FIG. 4 is a partially enlarged sectional view of the hair treatment portions in FIG. 3.
Figure 5A:
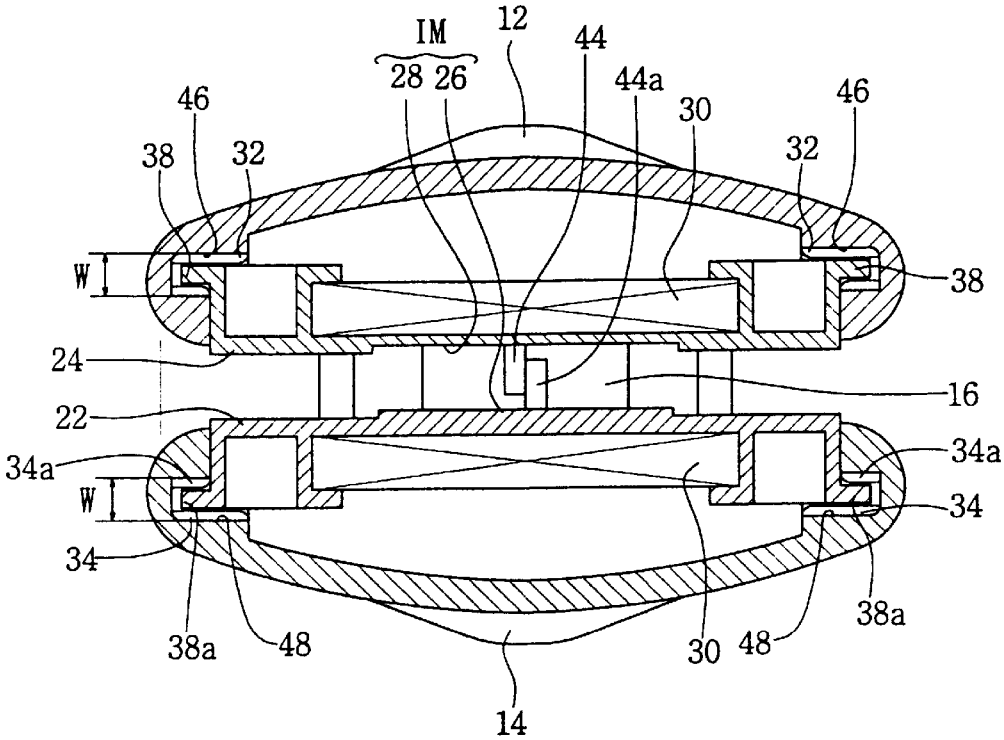
FIG. 5A shows the hair iron in an opening position and FIG. 5B shows the hair iron in a closing position.
Figure 5B:
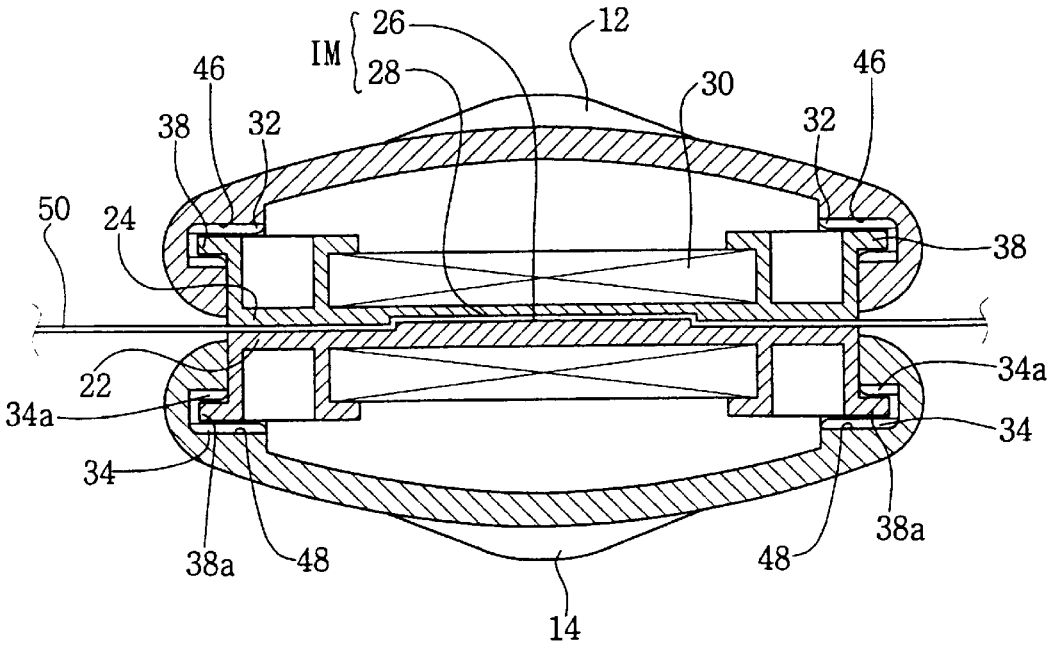

Therefore, especially referring to FIGS. 4 and 5, when the arms 12 and 14 are opened, the front edges of the hair treatment members 22 and 24 are kept upheaved by the respective resilient restoring members 40 and 42 with the corresponding supporting protrusions 32 and 34 as the supporters therefor. On the contrary, when the arms 12 and 14 are closed, the hair treatment members 22 and 24 come into contact with each other at their opposed leading ends, and the following increasing force of gripping more stronger than the elastic force of the resilient restoring members 40 and 42 is applied to allow the hair treatment members 22 and 24 to bring a seesaw movement using the respective supporting protrusions 32 and 34 as the supporters for the members 22 and 24 so that in the hair treatment members 22 and 24, the leading ends fall while the rear ends rise. As a result, the opposed surfaces of the hair treatment members 22 and 24 come into even contact. Accordingly, as shown in FIG. 5B, the hair 50 is evenly and closely held between the hair treatment members 22 and 24 in all directions of front, rear, left and right so as to get a fine treatment of the hair. When the pressing force applied to the arms 12 and 14 is released, the hair treatment members 22 and 24 return to their initial positions by the resilient restoring members 40 and 42.

A pair of guide projections formed in the respective arms 12 and 14 of the hair iron 10 serve as a guide means not to be put out of joint with the opening and closing of the arms 12 and 14. Each free end of the guide projections 44 and 44*a* comes into contact with each other at their ends when the arms 12 and 14 are placed at their most opened positions and comes into slide contact with each other with the opening and closing of the arms 12 and 14. The hair iron 10 is also provided with an on-off switch 52 and a display lamp 54 for confirming whether the switch 52 is turned on. A power supply cord 30 provides electric power to the hair iron 10 in order to heat the heater 30.

Figure 6:
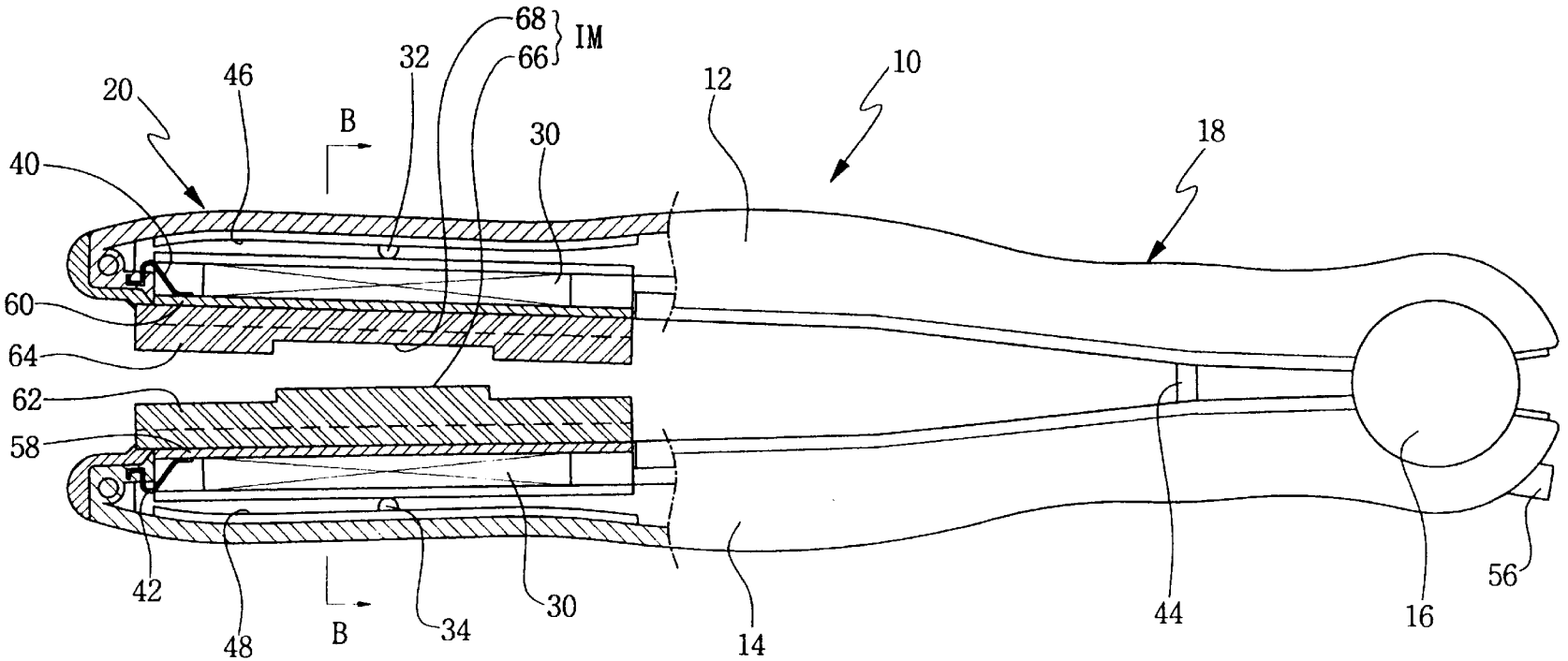
FIG. 6 is a side view of a hair iron with a partially sectional view of hair treatment portions, according to another embodiment of the present invention.
Figure 7A:
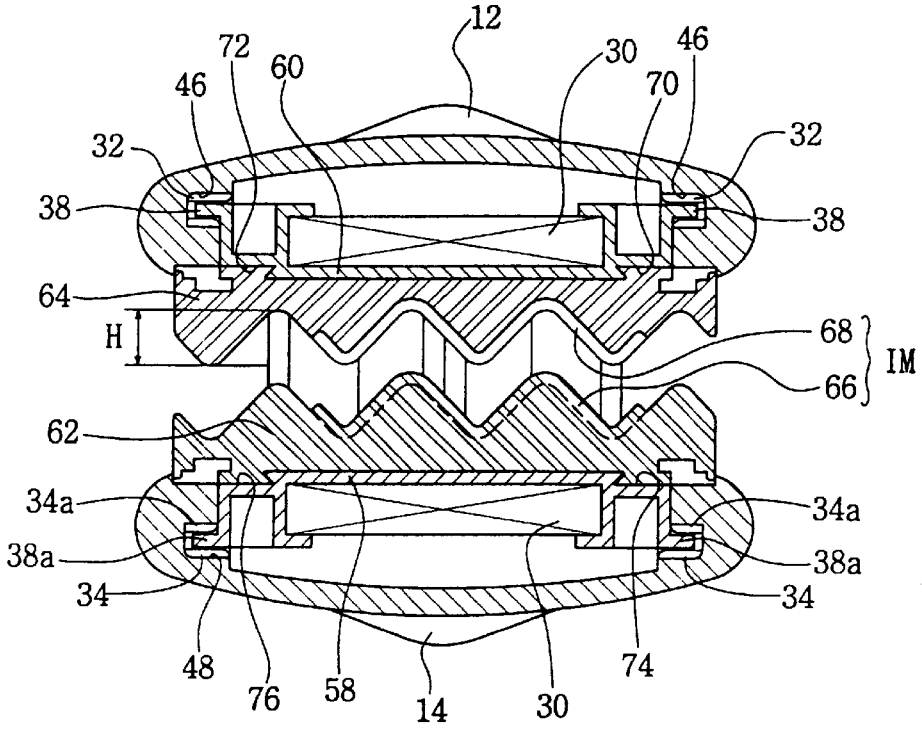
FIG. 7A shows the hair iron in an opening position and FIG. 7B shows the hair iron in a closing position.
Figure 7B:
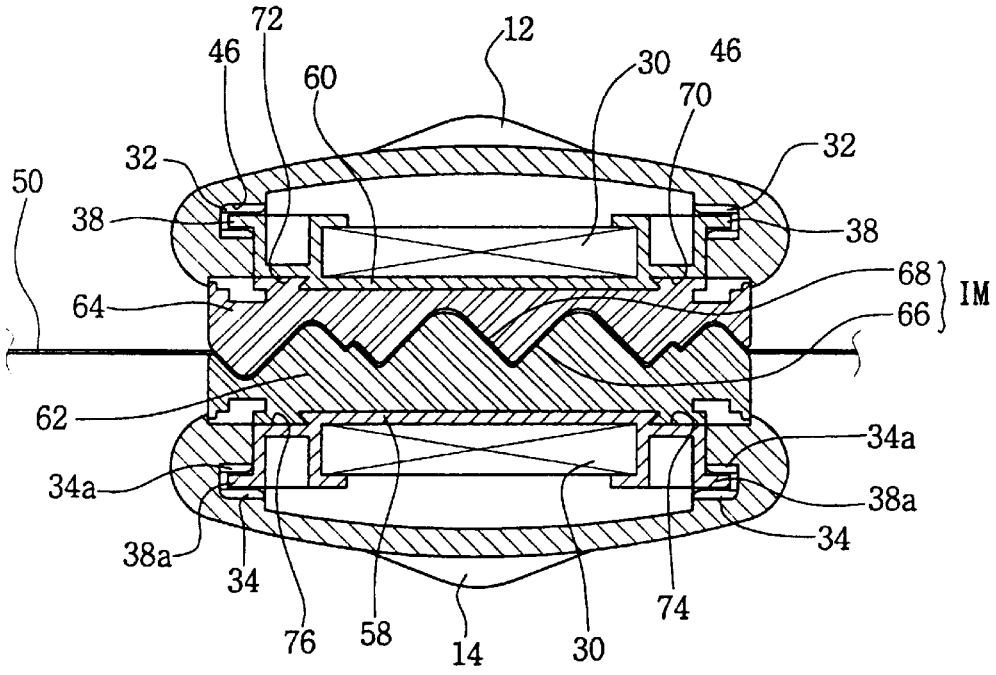

FIGS. 6 and 7A and 7B show another embodiment of the hair iron 10 according to the present invention and like numerals are given to like elements as in the first embodiment. The hair iron 10 includes a pair of arms 12 and 14 joined by a pivot 16 to be opened and closed, and gripping portions 18 and hair treatment portions 20, both being provided with the respective arms 12 and 14. Hair treatment portions 20 are provided with the respective planar hair treatment members 58 and 60 each having a top planar surface, and in turn, undulating hair treatment members 62 and 64 with opposed undulating surfaces, respectively, are placed on the corresponding planar hair treatment members 58 and 60. Each planar hair treatment member 58, 60 is provided with a heater 30 and is supported by a supporting protrusion 32, 34 formed in the respective arms 12, 14 at about the middle in a longitudinal direction thereof. The planar hair treatment members 58 and 60 are supported at their bottom surfaces by the resilient restoring members 40 and 42, respectively. Wings 38 and 38*a* each extending from either sides of each hair treatment member 58, 60 are placed on the respective rails 46 and 48 elongated along the longitudinal axes of the respective arms 12 and 14 in such a manner that the hair treatment members 58 and 60 make a seesaw movement using the supporting protrusions 32 and 34 as their levers. The respective widths of the rails 46 and 48 are spacious enough to make a seesaw movement with the wings 38 and 38*a* retained therein.

Each of the planar hair treatment members 58 and 60 includes a top planar surface and two rails 70 and 74 each elongated along either sides of the top planar surface in a longitudinal direction thereof. Each leading end of the rails 70 and 74 extends vertically to be connected to the respective wings 38 and 38*a*. The rails 46 and 48 in the respective arms 12 and 14 are engaged slidably and detachably to the respective planar hair treatment members 58 and 60 by the corresponding wings 38 and 38*a*. Heaters 30 are arranged to provide electric power to the planar hair treatment members 58 and 60. The planar hair treatment members 58 and 60 may have convex and concave image markers opposed to each other and formed on their top planar surfaces.

Undulating surfaces are provided on the opposing surfaces of the undulating hair treatment members 62 and 64 and, in turn, an image marker IM of concave and convex images 66 and 68 is provided with the undulating surfaces in such a way that the concave and convex images 66 and 68 face each other so as to match when the arms 12 and 14 are closed. Therefore, when the arms 12 and 14 are closed, the undulating hair treatment members 62 and 64 approach and not only the undulating surfaces but also the concave and convex images 66 and 68 match each other so as to allow for the hair to be held between the undulating surfaces and images 66 and 68. The undulating hair treatment members 62 and 64 are detachably engaged with the respective planar hair treatment members 58 and 60 in such a manner that a pair of joining bars 72 and 76 are formed on the bottom of each undulating hair treatment members 62 and 64 along the longitudinal direction thereof relative to the rails 70 and 74 of the planar hair treatment members 58 and 60, and the joining bars 72 and 76 are slidably seated on the respective rails 70 and 74 and releasably locked by a locker (not shown).

That the undulating hair treatment members 62 and 64 are detachably joined to the planar hair treatment members 58 and 60 allows various types of hair to be treated without preparing separate hair irons. Namely, the planar hair treatment members 58 and 60 are suitable for straight, thick hair while the undulating hair treatment members 62 and 64 are suitable for frizzled, thin and soft hair. The wave height and pitch of the undulating hair treatment members 62 and 64 can be sized to be adaptable to various types of hair.

In operation, the hair treatment members 22 and 24, 58 and 60, or/and 62 and 64 are heated to its desired temperature. Then hair is placed between the hair treatment members and the hair iron is closed to hold and press the hair. Next, the hair iron 10 is slowly shifted from the hair root side toward the hair tip side. At this time, the planar hair treatment members 58 and 60 are suitable for straight hair and the undulating hair treatment members 62 and 64 are preferable for frizzled hair. However, even for the straight hair, the undulating hair treatment members 62 and 64 can also be used. When treating the frizzled hair using the hair iron of the present invention, holding of the hair between the hair treatment members and shifting of the hair iron from the hair root to the hair tip may be repeated until the frizzled hair becomes straight enough.

As the arms 12 and 14 approach each other, the hair is held between the hair treatment members 22, 24, 58, 60, 62 and 64, and with the increase of pressure against the arms 12 and 14, the hair treatment members make a seesaw movement using the supporting protrusions 32 and 34 as their levers so that the hair is evenly held between the hair treatment members.

Figure 8:
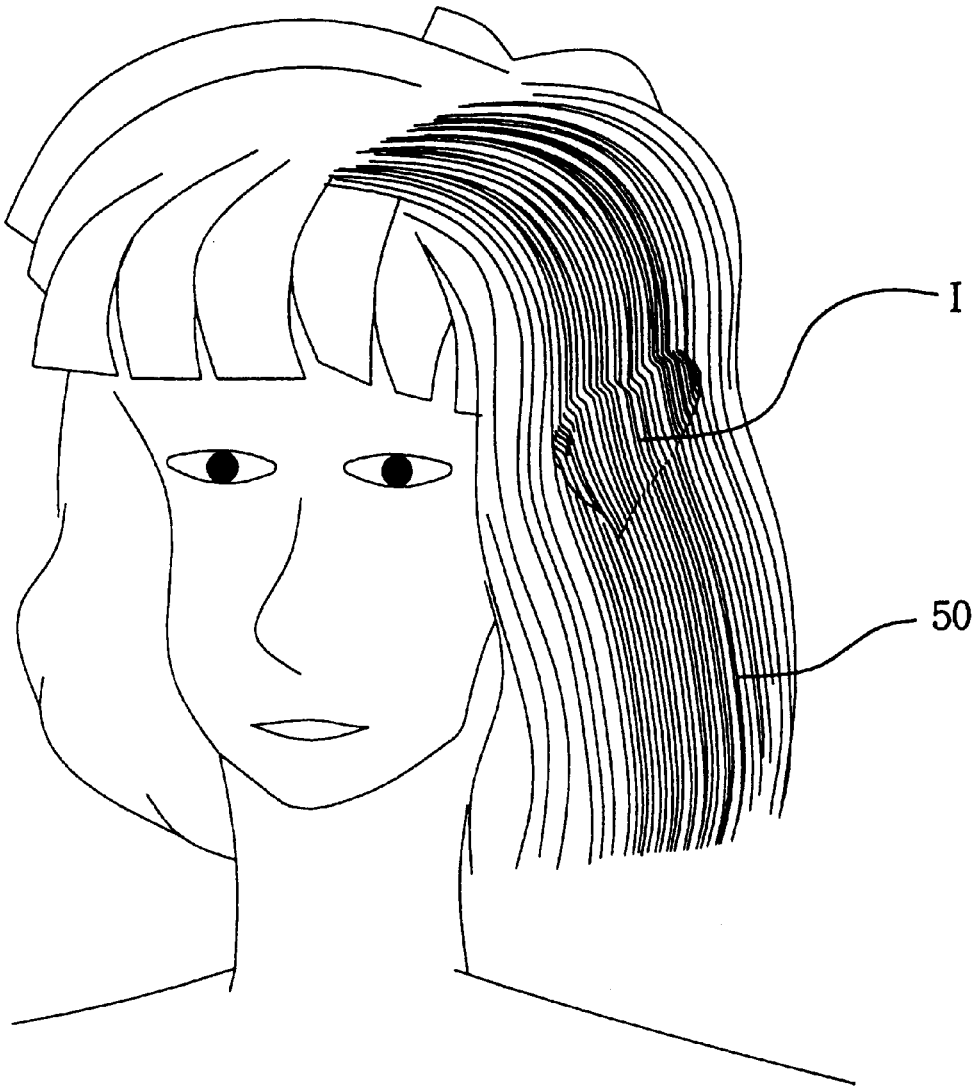
FIG. 8 illustrates an image formed on the user's hair using the hair iron of the present invention.

With the hair iron of the present invention, it is possible to impart an image of a character, figure or design with the desired part of the hair by holding the hair between the hair treatment members 22, 24, 62 or 64, which are provided with the image marker IM, and then by pressing the hair for a certain period of time with the gripping pressure of the arms 12 and 14. During this process, that part of the hair placed and pressed and heated between the concave and convex images 26, 28, 66 and 68 is imparted in a region-wise manner with a heart as shown in FIG. 8. When deforming the image I formed in the hair 50, the steps of gripping the hair with the imparted image between the hair treatment members 22, 24, 62, 64 and then slowly shifting the hair iron toward the tip side are repeated.

The invention has been described in detail in connection with a preferred embodiment, various modifications, however, may be made without departing from the scope or spirit of this invention defined in the claims. For example, in the preferred embodiments of the present invention the arms 12 and 14 are opened and closed by the pivot 16 which joins the arms 12 and 14 together at their one-sided ends. To the contrary, the arms 12 and 14 can be movably joined together at their middle position by, for example, a pin, and the arms are crossed each other and hingedly moved using the pin as a lever like scissors. The image marker of the present invention can also be applied to this modification.

Furthermore, one of the arms may be cylindrical while the other may be a clip type rotatably connected to the cylindrical arm, in which hair is held between the outer peripheral surface of the cylindrical arm and the clip arm according to the rotatable upward-downward movement of the clip arm. The image marker of the present invention can also be applied to this modification to this invention.

What is claimed is:

1. A hair iron comprising:

a gripping portion;

at least two hair treatment members designed to be heated up for pressing and treating hair therebetween; and an image marker having a first image marker and a second image marker provided on opposing surfaces of said hair treatment members for imparting an image with the hair by holding and pressing the hair between said hair treatment members when said hair treatment members approach each other;

wherein said hair treatment members comprise a pair of planar hair treatment members having planar top opposed surfaces and a pair of undulating hair treatment members having undulating top opposed surfaces, wherein said undulating hair treatment members are detachably joined to the respective planar hair treatment members.

2. The hair iron of claim 1, wherein said opposing surfaces of said hair treatment members are planar.

3. The hair iron of claim 1, wherein said hair treatment members comprise undulating surfaces provided on opposing surfaces thereof so that when said hair treatment members hold the hair, not only the first image marker and the second image marker but also said undulating surfaces are matched each other so as to treat the hair.

4. A hair iron comprising:

a pair of arms joined together by a pivot to be able to open and close said arms, and each having a gripping portion disposed near said pivot;

a pair of hair treatment members disposed away from said pivot for treating hair by holding and pressing the hair according to the opening and closing of said arms;

a heating means for heating at least one of said hair treatment members; and a first and second markers provided on opposing surfaces of said hair treatment members for imparting an image with the hair, the image marker being matched when said arms are closed;

wherein said hair treatment members comprise a pair of planar hair treatment members having planar top opposed surfaces and a pair of undulating hair treatment members having undulating top opposed surfaces, wherein said undulating hair treatment members are detachably joined to the respective planar hair treatment members.

5. The hair iron of claim 4, wherein said opposing surfaces of said hair treatment members are planar.

6. The hair iron of claim 4, wherein said hair treatment members comprise undulating surfaces provided on opposing surfaces thereof so that when said hair treatment members hold the hair, not only the first image and second image of said image marker but also said undulating surfaces are matched each other so as to treat the hair.

7. The hair iron of claim 4, wherein a hair iron comprising:

a pair of arms joined together by a pivot to be able to open and close said arms, and each having a gripping portion disposed near said pivot;

a pair of hair treament members disposed away from said pivot for treating hair by holding and pressing the hair according to the opening and closing of said arms;

a heating means for heating at lest one of said hair treatment members; and a concave and convex first and second image markers provided on opposing surfaces of said hair treatment members for imparting an image with the hair, the image marker being matched when said arms are closed;

wherein said hair treatment members comprise a pair of planar hair treatment members having planar top opposed surfaces and a pair of undulating hair treatment members having undulating top opposed surfaces, wherein said undulating hair treatment members are detachably joined to the respective planar hair treatment members.

8. The hair iron of claim 7, wherein said hair treatment members comprise supporting protrusions each supporting the middle of the corresponding hair treatment members so that when said arms are closed, said hair treatment members make a seesaw movement using the respective supporting protrusions as their levers so as to allow said hair treatment members to come into even and close contact with the hair.

9. The hair iron of claim 7, wherein said arms further comprise resilient restoring members each provided between the respective arms and hair treatment members so that when said arms are opened, the displacement took place by the seesaw movement when said arms are closed is removed so as to restore the initial position of said hair treatment members.

* * * * *